US009966663B1

(12) United States Patent
Chen et al.

(10) Patent No.: US 9,966,663 B1
(45) Date of Patent: May 8, 2018

(54) DUAL-BAND ANTENNA MODULE

(71) Applicant: UNIVERSAL SCIENTIFIC INDUSTRIAL (SHANGHAI) CO., LTD., Shanghai (CN)

(72) Inventors: Hsin-Hong Chen, Shanghai (CN); Jui-Kun Shih, Shanghai (CN); Chun-Huan Lee, Shanghai (CN); Jui-Chih Chien, Shanghai (CN); Chih-Sen Hsieh, Shanghai (CN)

(73) Assignee: UNIVERSAL SCIENTIFIC INDUSTRIAL (SHANGHAI) CO., LTD., Shanghai (CN)

( * ) Notice: Subject to any disclaimer, the term of this patent is extended or adjusted under 35 U.S.C. 154(b) by 22 days.

(21) Appl. No.: 15/386,598

(22) Filed: Dec. 21, 2016

(30) Foreign Application Priority Data

Oct. 21, 2016 (CN) ..... 2016 1 0919775

(51) Int. Cl.

| | |
|---|---|
| ***H01Q 1/24*** | (2006.01) |
| ***H01Q 5/307*** | (2015.01) |
| ***H01Q 1/22*** | (2006.01) |
| ***H01Q 1/48*** | (2006.01) |
| ***H01Q 1/38*** | (2006.01) |

(Continued)

(52) U.S. Cl.
CPC ..... *H01Q 5/307* (2015.01); *H01Q 1/2291* (2013.01); *H01Q 1/36* (2013.01); *H01Q 1/38* (2013.01); *H01Q 1/48* (2013.01); *H01Q 5/35* (2015.01); *H01Q 21/28* (2013.01)

(58) Field of Classification Search
CPC ..... H01Q 1/24; H01Q 1/241; H01Q 1/243; H01Q 5/307; H01Q 5/35; H01Q 1/2291; H01Q 21/28
See application file for complete search history.

(56) References Cited

U.S. PATENT DOCUMENTS 7,151,500 B2 12/2006 Su et al.
2011/0241950 A1* 10/2011 Milosavljevic ..... H01Q 1/52 343/702

(Continued)

FOREIGN PATENT DOCUMENTS

TW I478443 B 3/2015
TW I514678 B 12/2015

*Primary Examiner* — Hoang Nguyen
(74) *Attorney, Agent, or Firm* — Li & Cai Intellectual Property (USA) Office

(57) ABSTRACT

A dual-band antenna module is provided. The dual-band antenna module includes a circuit board, a ground coupling portion electrically connected to a reference ground plane of the circuit board, a first antenna, and a second antenna spaced from the first antenna. The first antenna and the ground coupling portion are disposed on the circuit board and configured to couple each other. The first antenna includes a first radiation unit, a U-shaped conductive frame, and a first feeding portion. The U-shaped conductive frame is disposed on the first radiation unit and opens toward the circuit board. The second antenna includes a second radiation unit, a high-frequency impedance portion, and a second feeding portion. The second radiation unit and the high-frequency impedance portion are respectively disposed on two opposite surfaces of the circuit board to resonate to each other. The second radiation unit includes a ground extension portion electrically grounded.

11 Claims, 6 Drawing Sheets

(51) Int. Cl.

| | |
|---|---|
| ***H01Q 1/36*** | (2006.01) |
| ***H01Q 5/35*** | (2015.01) |
| ***H01Q 21/28*** | (2006.01) |

(56) References Cited

U.S. PATENT DOCUMENTS

| | | | | |
|---|---|---|---|---|
| 2012/0274536 | A1 | 11/2012 | Pan | |
| 2014/0198012 | A1* | 7/2014 | Tseng | H01Q 21/28 343/876 |
| 2014/0210673 | A1 | 7/2014 | Wang et al. | |
| 2016/0204499 | A1* | 7/2016 | Toh | H01Q 1/24 343/702 |

* cited by examiner

DUAL-BAND ANTENNA MODULE

BACKGROUND OF THE INVENTION

1. Field of the Invention

The instant disclosure relates to an antenna module; in particular, to a dual-band antenna module capable of dual frequency bands operation.

2. Description of Related Art

With the development of the mobile communication technology, portable electronic products have become more and more popular in recent years, and these portable electronic products usually emit or receive radio waves through a wireless communication device to transmit or exchange radio signals and access wireless networks.

Antenna is one of the most important elements of the wireless communication device. However, the antenna usually has larger size or area than the other elements of the wireless communication device. With the development of the portable electronic products having the wireless communication device toward the trend of the "light-weight, thin, short and small" design, the size of the antenna has to become smaller to meet the trend.

Some of the wireless communication devices have to support more than one frequency bands (for example, 2.4 GHz and 5 GHz) for operation. These wireless communication devices are usually equipped with the antenna having a three-dimensional structure to provide a better radiation effect. Furthermore, the three-dimensional antenna usually has an irregular shape for different frequency-bands operation. For a wireless communication device to be downsized, it is one of the factors that make it difficult to reduce the space that the wireless communication device occupied by arranging a three-dimensional antenna having an irregular shape. In addition, the fabrication of the 3D antenna having an irregular shape is more difficult and the material cost may increase.

SUMMARY OF THE INVENTION

In order to provide a solution of the aforementioned problem, a dual-band antenna module is provided in the instant disclosure. By replacing a portion of non-planer or 3D structure with planar structure, the material cost of the dual-band antenna module can be reduced and the dual-band antenna module satisfies the demands of 2.4 GHz band and 5 GHz band operation.

A dual-band antenna module provided in one of the embodiments of the instant disclosure includes a circuit board, a ground coupling portion, a first antenna and a second antenna. The circuit board has a reference ground plane arranged therein. The ground coupling portion is disposed on the circuit board and electrically connected to the reference ground plane. The first antenna is disposed on the circuit board and spaced from the ground coupling portion, in which the first antenna and the ground coupling portion are configured to couple each other, the first antenna includes a first radiation unit, a first feeding portion disposed on the first radiation unit, a U-shaped conductive frame disposed on the first radiation unit, and the U-shaped conductive frame opening toward the circuit board. The second antenna spaced from the first antenna includes a second radiation unit, a high-frequency impedance portion, and a second feeding portion disposed on the second radiation unit. The second radiation unit and the high-frequency impedance portion are respectively disposed on two opposite surfaces of the circuit board to resonate to each other, and the second radiation portion includes a ground extension portion electrically connected to the reference ground plane.

To sum up, the dual-band antenna module provided in the instant disclosure capable of supporting the 2.4 GHz band and 5 GHz band has the first and second antennas both mainly including a two-dimensional structure so that the space that the dual-band antenna module occupied is reduced and the cost can be saved.

In order to further understand the instant disclosure, the following embodiments are provided along with illustrations to facilitate the disclosure of the instant disclosure.

DETAILED DESCRIPTION OF THE PREFERRED EMBODIMENTS

Figure 1:
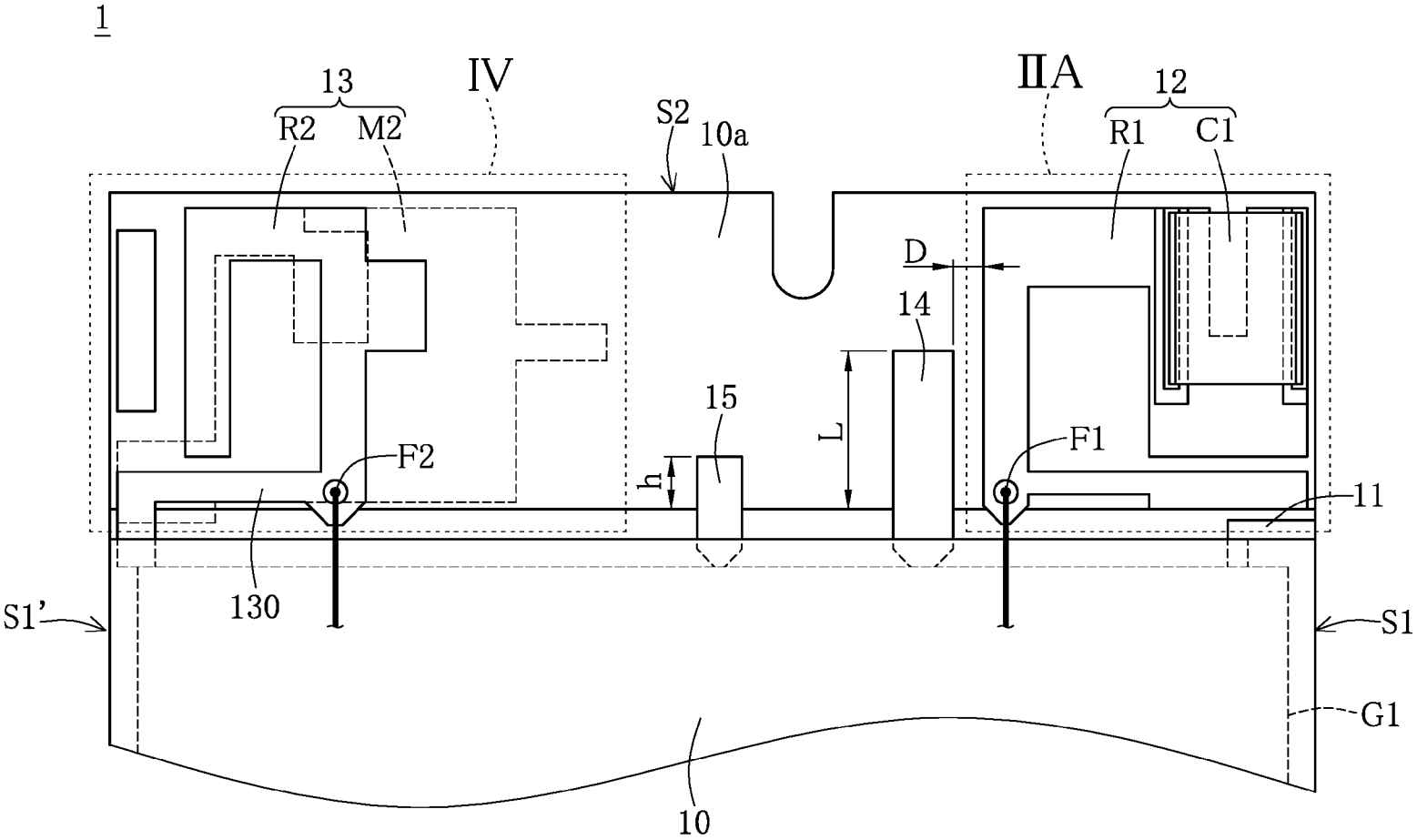
FIG. 1 shows a top view of a dual-band antenna module according to an embodiment of the instant disclosure.

Please refer to FIG. 1. FIG. 1 shows a top view of a dual-band antenna module according to an embodiment of the instant disclosure. The dual-band antenna module 1 can be implemented in a wireless communication device and supports 2.4 GHz band and 5 GHz band. The dual-band antenna module 1 includes a circuit board 10, a ground coupling portion 11, a first antenna 12, and a second antenna 13.

Figure 5:
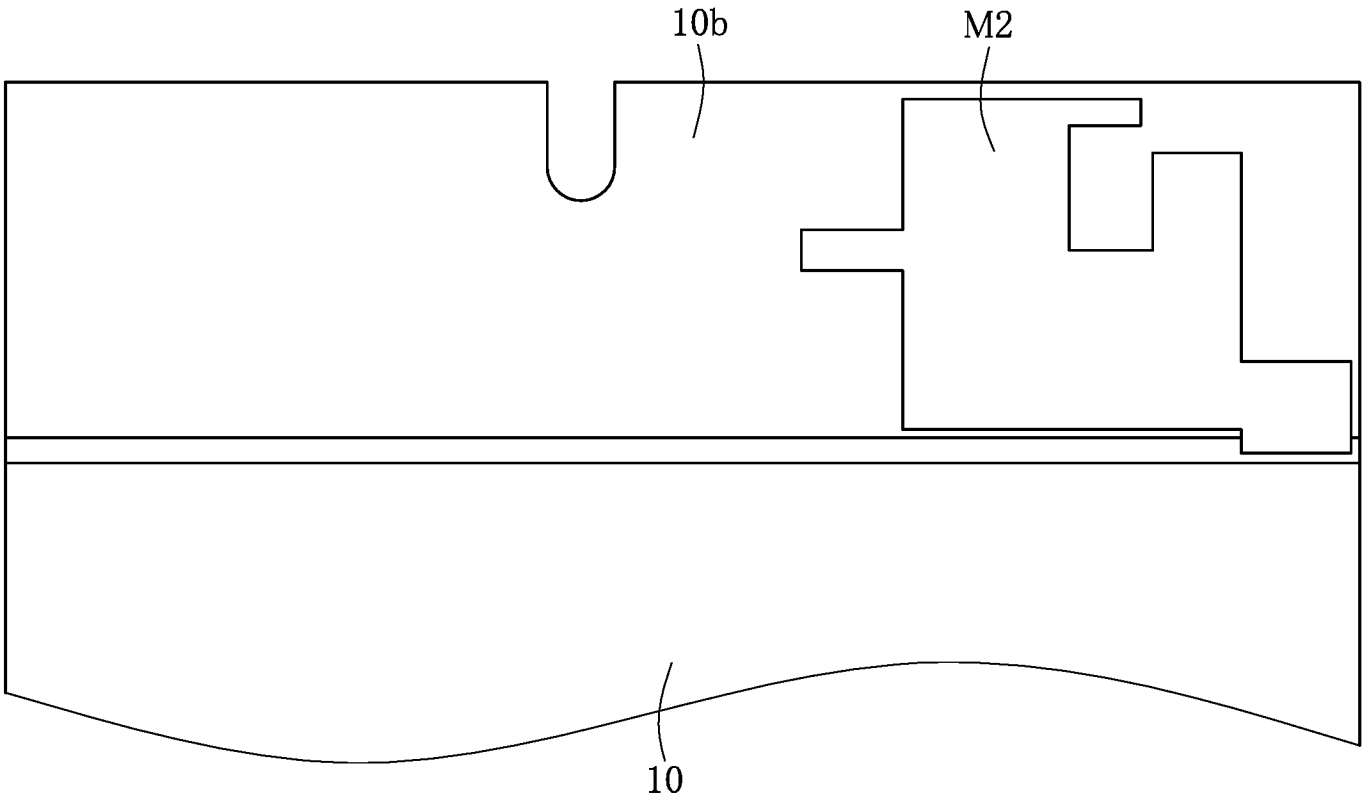
FIG. 5 shows a bottom view of the dual-band antenna module shown in FIG. 1.

Please refer to FIG. 1 and FIG. 5, in which FIG. 5 shows a bottom view of the dual-band antenna module 1. The circuit board 10 can be a printed circuit board (PCB) or a flexible printed circuit board (FPC). The circuit board 10 has a first surface 10*a*, a second surface 10*b* opposite to the first surface 10*a*, and a reference ground plane G1. The reference ground plane G1 is arranged in the circuit board 10, i.e., the reference ground plane G1 is arranged between the first surface 10*a* and the second surface 10*b*, but this is not intended to limit the instant disclosure.

As shown in FIG. 1, the ground coupling portion 11 is disposed on the first surface 10*a* of the circuit board 10 and electrically connected to the reference ground plane G1. In one embodiment, the ground coupling portion 11 can be electrically connected to the reference ground plane G1 through, but not limited to, a conductive via (not shown).

Furthermore, the first antenna 12 and the second antenna 13 are arranged along a short side S2 of the circuit board 10 and spaced from each other. In the instant embodiment, the first antenna 12 and the second antenna 13 are respectively arranged at two adjacent corner regions of the circuit board 10.

In the embodiment of the instant disclosure, the first antenna 12 is not grounded and disposed on the first surface 10*a* of the circuit board 10. Specifically, the first antenna 12 is arranged at one of the corner regions of the circuit board 10. The first antenna 12 and the ground coupling portion 11 are configured to couple with each other instead of being electrically connected to each other. The first antenna 12 includes a first radiation unit R1, a first feeding portion F1, and a U-shaped conductive frame C1.

Figure 2A:
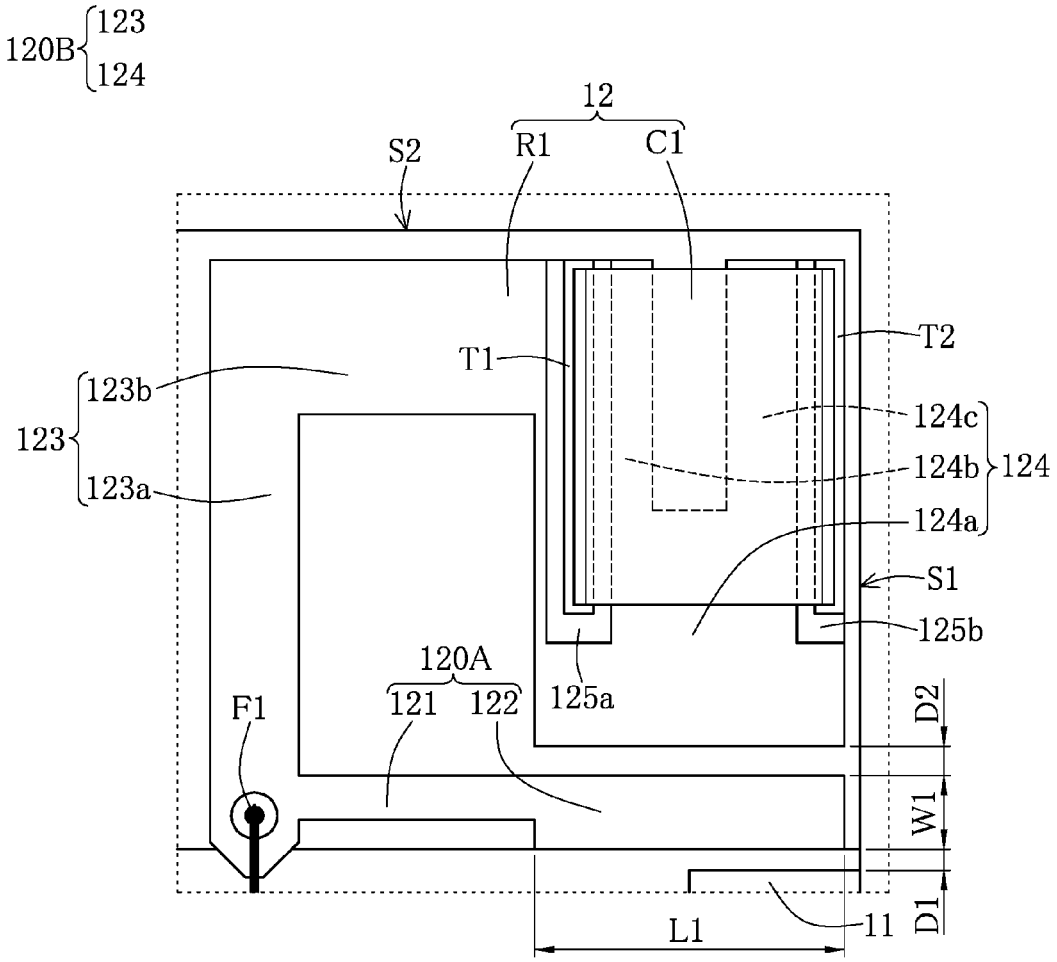
FIG. 2A shows an enlarged view for enlarging "IIA" part shown in FIG. 1.

Please refer to FIG. 2A, which shows an enlarged view for enlarging the "IIA" part shown in FIG. 1. As shown in FIG. 2A, the first radiation unit R1 can be a conductive wiring pattern fabricated by printed or etching processes. That is to say, the first radiation unit R1 is a planar and a two-dimensional structure. The first radiation unit R1 can be made of conductive material, such as Cu, Fe, Ni, Cr, or the combinations thereof. The U-shaped conductive frame C1 with 3D structure is disposed on the first radiation unit R1 and partially covers the first radiation unit R1.

Figure 2B:
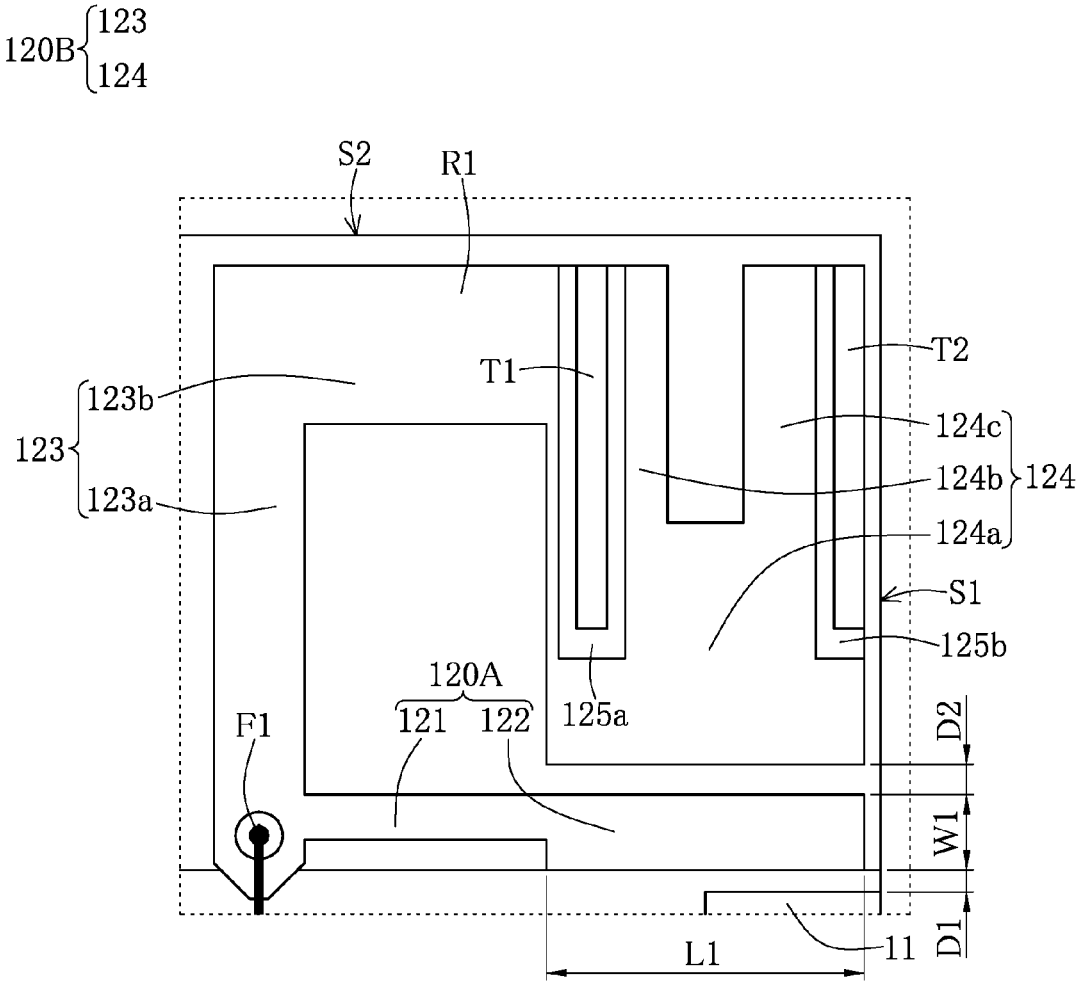
FIG. 2B shows an enlarged view of a first radiation unit according to an embodiment of the instant disclosure.

Please refer to FIG. 2B, which shows an enlarged view of the first radiation unit R1 according to an embodiment of the instant disclosure. Specifically, the first radiation unit R1 includes a high-frequency radiation portion 120A and a first low-frequency radiation portion 120B, and the first feeding portion F1 is located at a juncture of the high-frequency radiation portion 120A and the first low-frequency radiation portion 120B. The high-frequency radiation portion 120A offers a higher operating frequency band, and the first low-frequency radiation portion 120B offers a lower operating frequency band than that of the high-frequency radiation portion 120A. In the instant embodiment, a center frequency of an operating frequency band capable of being resonated and generated by the high-frequency radiation portion 120A is located at about 5 GHz, and a center frequency of the operating frequency band capable of being resonated and generated by the first low-frequency radiation portion 120B is located at about 2.4 GHz.

In addition, in the instant embodiment, the high-frequency radiation portion 120A is formed in a linear shape which has an extending direction from the first feeding portion F1 to a long side S1 of the circuit board 10 farther away from the second antenna 13. The extending direction of the high-frequency radiation portion 120A is substantially parallel to the short side S2 of the circuit board 10.

The high-frequency radiation portion 120A provides current paths so that the first antenna 12 can operate at the 5 GHz band. Additionally, the high-frequency radiation portion 120A can be electrically coupled with the ground coupling portion 11, which is electrically connected to the reference ground plane G1. The high-frequency radiation portion 120A includes a connecting section 121 close to the first feeding portion F1 and an end section 122 farther away from the first feeding portion F1. The connecting section 121 has a width less than that of the end section 122.

Notably, the operating bandwidth and performance of the dual-band antenna module 1 are influenced by the length L1 of the end section 122, the width W1 of the end section 122, and the distance D1 between the end section 122 and the ground coupling portion 11. In one embodiment, the length L1 of the end section 122 ranges from 5 mm to 6 mm, the width W1 of the end section 122 ranges from 1 mm to 1.5 mm, and the distance D1 ranges from 0.3 mm to 1 mm.

The first low-frequency radiation portion 120B provides current paths so that the first antenna 12 can operate at 2.4 GHz band.

As shown in FIG. 2B, the first low-frequency radiation portion 120B includes an L-shaped portion 123 and a U-shaped curved portion 124. The L-shaped portion 123 has a long section 123*a* and a short section 123*b*. The long section 123*a* has one end connecting the first feeding portion F1 and the other end connecting one end of the short section 123*b*, and the other end of the short section 123*b* connects the U-shaped curved portion 124. In the instant embodiment, the short section 123*b* has a width larger than that of the long section 123*a*, and the short section 123*b* extends in a direction from the long section 123*a* to the long side S1 of the circuit board 10 farther away from the second antenna 13. The short section 123*b* is arranged substantially parallel to the high-frequency radiation portion 120A.

The U-shaped curved portion 124 includes a straight-line portion 124*a*, a bridging portion 124*b* connecting between one end of the straight-line portion 124*a* and the L-shaped portion 123, and an extending portion 124*c* connecting the other end of the straight-line portion 124*a*. The U-shaped curved portion 124 opens toward the short side S2 of the circuit board 10. That is, each of the bridging portion 124*b* and the extending portion 124*c* extends from the straight-line portion 124*a* towards the short side S2 in a direction parallel to the long side S1 of the circuit board 10.

Specifically, the bridging portion 124*b* is substantially perpendicular to the short section 123*b* of the L-shaped portion 123 and substantially parallel to the long section 123*a* of the L-shaped portion 123.

The straight-line portion 124*a* connects one end of the bridging portion 124*b*, and the straight-line portion 124*a* is arranged parallel to the high-frequency radiation portion 120A. Specifically, the straight-line portion 124*a* extends from the bridging portion 124*b* toward the long side S1 until an edge of the straight-line portion 124*a* is collinear with an edge of the high-frequency radiation portion 120A. The straight-line portion 124*a* and the end section 122 of the high-frequency radiation portion 120A are spaced from each other by a distance D2.

Notably, the straight-line portion 124*a*, the end section 122 of the high-frequency radiation portion 120A, and the ground coupling portion 11 are configured to couple one another so that the dual-band antenna module 1 can operate at a predetermined bandwidth. Accordingly, the operating frequency and bandwidth of the dual-band antenna module 1 also can be influenced by the distance D2 between the straight-line portion 124*a* and the end section 122. In one embodiment, the distance D2 between the straight-line portion 124*a* and the end section 122 ranges from 0.3 mm to 1 mm.

Please refer to FIG. 2A and FIG. 2B. The extending portion 124*c* connects the other end of the straight-line portion 124*a*, and the extending portion 124*c* is substantially parallel to the bridging portion 124*b*. Additionally, when the U-shaped conductive frame C1 is disposed on the circuit board 10, the U-shaped conductive frame C1 partially shields the U-shaped curved portion 124.

In the instant embodiment, the first antenna 12 further includes two solder mask patterns 125*a*, 125*b* formed on the U-shaped curved portion 124 to respectively define two preset regions T1, T2.

The solder mask patterns 125*a*, 125*b* can be made of insulating material, and can be, but are not limited to, dry film solder mask (DFSM) or liquid photoimageable solder mask (LPSM), thermally curable solder-resistant ink, or UV-curable ink.

The solder mask patterns 125*a*, 125*b* are formed on the U-shaped curved portion 124 for respectively defining two preset regions T1, T2. One of the preset regions (T1) is located at the bridging portion 124*b*, and the other preset region T2 is located at the extending portion 124*c*.

Figure 3:
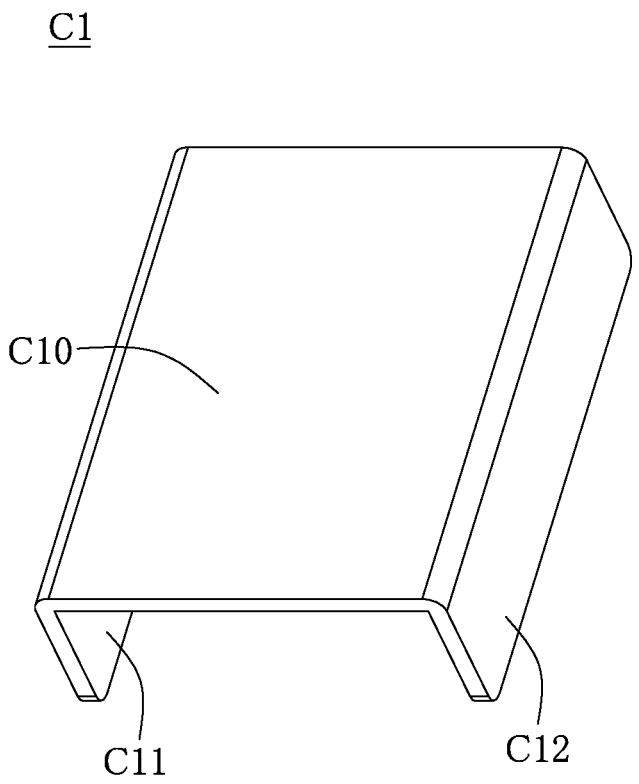
FIG. 3 shows a perspective view of a U-shaped conductive frame according to an embodiment of the instant disclosure.

Please refer to FIG. 2A and FIG. 3. FIG. 3 shows a perspective view of a U-shaped conductive frame according to an embodiment of the instant disclosure. As mentioned above, the U-shaped conductive frame C1 is disposed on the U-shaped curved portion 124.

As shown in FIG. 3, the U-shaped conductive frame C1 having a three-dimensional structure includes a plate C10 and two sidewalls C11, C12. The two sidewalls C11, C12 protrude in the same direction of the plate C10 and respectively extend from two opposite long sides of the plate C10 in a direction perpendicular to the surface of the plate C10. As such, in the embodiment of the instant disclosure, the first antenna 12 includes not only the 3D structure (the U-shaped conductive frame C1) but also the 2D structure (the first radiation unit R1).

Please refer to FIG. 2A. The U-shaped conductive frame C1 is disposed on the circuit board 10 and opens toward the first radiation unit R1. Furthermore, the U-shaped conductive frame C1 disposed on the circuit board 10 partially covers the U-shaped curved portion 124. Specifically, two sidewalls C11, C12 of the U-shaped conductive frame C1 respectively connect two preset regions T1, T2 so that the U-shaped conductive frame C1 is disposed across over the bridging portion 124*b* and the extending portion 124*c*.

In the instant embodiment, the solder can be formed on the two preset regions T1, T2. Thereafter, the two sidewalls C11, C12 of the U-shaped conductive frame C1 are respectively disposed on two preset regions T1, T2 so that the U-shaped conductive frame C1 can be welded to and disposed on the U-shaped curved portion 124 by the reflow process. The flow of the solder can be limited to the preset regions T1, T2 by applying the solder mask patterns 125*a*, 125*b* during the reflow process, thereby preventing the shape of the first radiation unit R1 from being changed due to the overflow of the solder and then impacting the performance of the dual-band antenna module 1.

Furthermore, it is worth noting that the U-shaped conductive frame C1 disposed on the U-shaped curved portion 124 also can enhance current paths so that the dual-band antenna module 1 can operate at a lower frequency band. The U-shaped conductive frame C1 can be fabricated by stamping a metal sheet whose material can be iron or copper. In another embodiment, the U-shaped conductive frame C1 can be made of a plastic member, the outer surface of which is coated with a metal layer.

Figure 4:
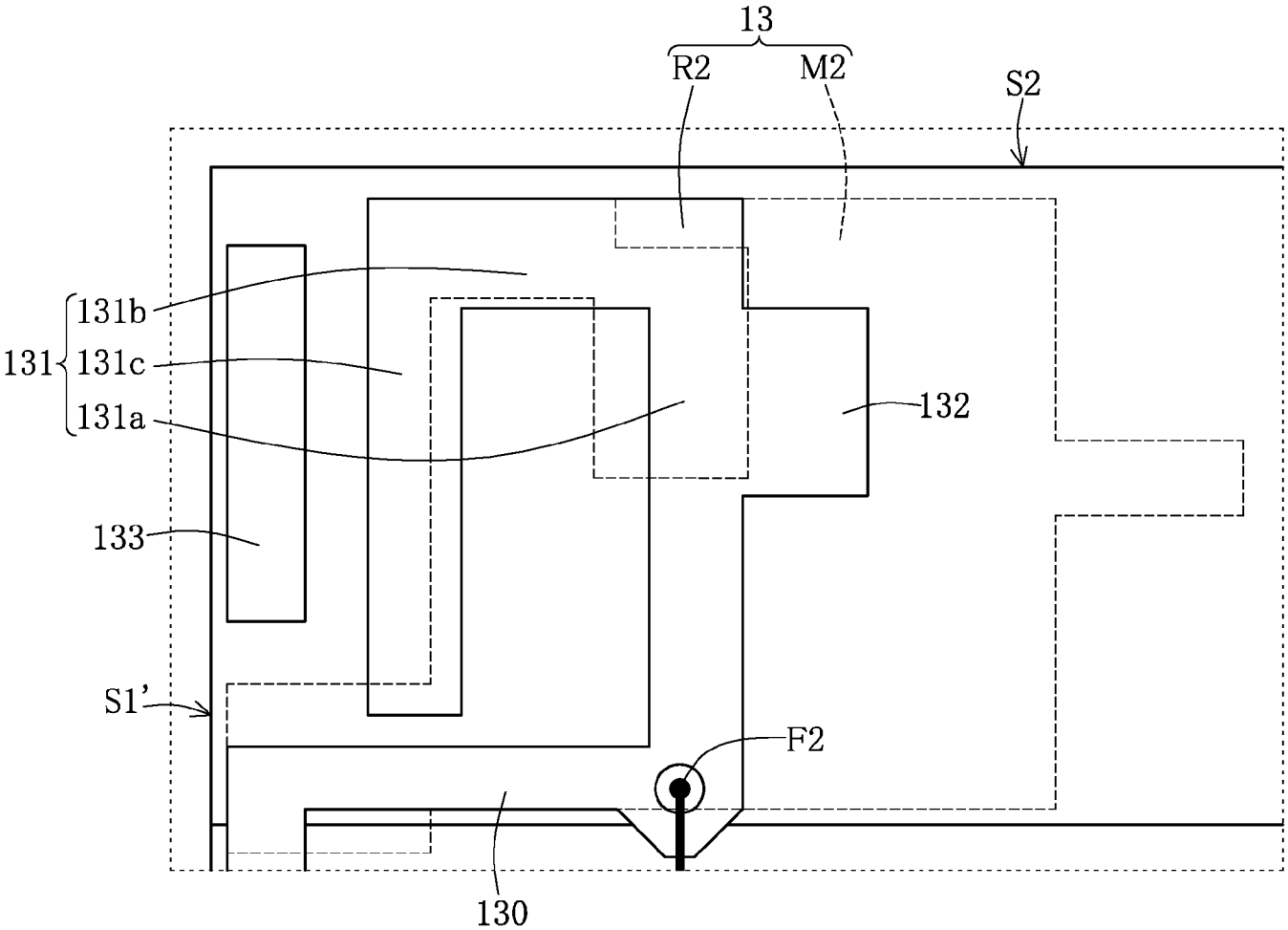
FIG. 4 shows an enlarged view for enlarging "IV" part shown in FIG. 1.

Subsequently, please refer to FIG. 1, FIG. 4 and FIG. 5. FIG. 4 shows an enlarged view for enlarging the "IV" part shown in FIG. 1, and FIG. 5 shows a bottom view of the dual-band antenna module shown in FIG. 1.

As shown in FIG. 1, the second antenna 13 is arranged at another corner region adjacent to the corner region where the first antenna 12 is arranged. Compared to the first antenna 12, the second antenna 13 does not have 3D structure. In addition, the second antenna 13 has a ground extension portion 130 electrically connected to the reference ground plane G1.

As shown in FIG. 4, the second antenna 13 includes a second radiation unit R2, a high-frequency impedance portion M2 located at the second surface 10*b*, and a second feeding portion F2. The second radiation unit R2 includes the ground extension portion 130, a second low-frequency radiation portion 131 and a first branch portion 132. The aforementioned second feeding portion F2 is located at a juncture of the ground extension portion 130 and the second low-frequency radiation portion 131.

Please refer to FIG. 1. The ground extension portion 130 extends in a direction away from the second feeding portion F2 to the other long side S1' of the circuit board 10 which is farther away from the first antenna 12. That is, an extending direction of the ground extension portion 130 is opposite to that of the high-frequency radiation portion 120A. Moreover, one end of the ground extension portion 130 connects the second feeding portion F2 and the other end of the ground extension portion 130 electrically grounded. Further, the other end of the ground extension portion 130 is electrically connected to the reference ground plane G1.

Please refer to FIG. 4. The second low-frequency radiation portion 131 and the ground extension portion 130 commonly form an opened loop pattern. The second low-frequency radiation portion 131 provides current paths so that the second antenna 13 of the dual-band antenna module 1 can operate at the 2.4 GHz band ranging from 2.402 GHz to 2.484 GHz.

Specifically, the second low-frequency radiation portion 131 includes a first connection section 131*a*, a second connection section 131*b*, and a third connection section 131*c*, in which the second connection section 131*b* connects between the first connection section 131*a* and the third connection section 131*c*.

The first connection section 131*a* is connected to the second feeding portion F2 with one end and extends in a direction from the second feeding portion F2 toward the short side S2 of the circuit board 10 which is farther away from the reference ground plane G1. One end of the second connection section 131*b* connects the other end of the first connection section 131*a* and extends in a direction far away from the first antenna 12. One end of the third connection section 131*c* connects the other end of the second connection section 131*b* and extends toward the ground extension portion 130. However, the other end of the third connection section 131*c* and the ground extension portion 130 are spaced from each other. Accordingly, the first, second, and third connection sections 131*a*-131*c* substantially form a U-shaped loop opening toward the ground extension portion 130.

The first branch portion 132 of the second radiation unit R2 extends in a direction from a side of the second low-frequency radiation portion 131 closest to the first antenna 12 toward the first antenna 12. Specifically, the first branch portion 132 protrudes from the side of the first connection section 131*a* closest to the first antenna 12.

In the instant embodiment, the second radiation unit R2 further includes a second branch portion 133 which is located between the long side S1' and the third connection section 131*c*. The second branch portion 133 has an extending direction substantially parallel to the third connection section 133*c*, but the second branch portion 133 is not physically connected to the ground extension portion 130. The second branch portion 133 can be configured to couple the second low-frequency radiation portion 131 to improve the efficiency of the dual-band antenna module 1. However, in another embodiment, the second branch portion 133 also can be omitted.

Please refer to FIG. 4 and FIG. 5. The high-frequency impedance portion M2 is disposed on the second surface 10*b* of the circuit board 10 corresponding to the position of the second radiation unit R2 on the first surface 10*a*. Furthermore, the high-frequency impedance portion M2 partially overlaps with a vertical projection of the second radiation unit R2 so that an electromagnetic wave having a frequency of approximate to 5 GHz can resonate between the second radiation unit R2 and the high-frequency impedance portion M2.

As shown in FIG. 4, the vertical projection of the high-frequency impedance portion M2 and the second low-frequency radiation portion 131 partially overlap with each other in a vertical direction (a normal direction of the first surface 10*a*). In the instant embodiment, the high-frequency impedance portion M2 has an irregular geometrical shape. However, as long as a resonation can be generated between the high-frequency impedance portion M2 and the second radiation unit R2 so that the dual-band antenna module 1 can transmit the electromagnetic wave signals having a frequency of 5 GHz, the shape of the high-frequency impedance portion M2 is not limited to the example provided herein.

Please refer to FIG. 1. The dual-band antenna module 1 further includes a first ground extending section 14 and a second ground extending section 15 both of which are arranged between the first and second antennas 12, 13 and electrically connected to the reference ground plane G1 of the circuit board 10. Furthermore, in the embodiment of the instant disclosure, the first and second ground extending sections 14, 15 are covered by a solder mask. A distance between the first ground extending section 14 and the first antenna 12 is less than a distance between the first ground extending section 14 and the second antenna 13. Notably, the first antenna 12, which is not electrically grounded, is configured to couple the second antenna 13 and the first ground extending section 14 so that the dual-band antenna module 1 can operate within multiple predetermined frequency bands.

Moreover, the length L of the first ground extending section 14 and a distance D between the first ground extending section 14 and the first antenna 12 may significantly influence the operating frequency band. Specifically, the longer the length L of the first ground extending section 14 is or the smaller the distance D is, the lower frequency band the operating frequency band of the dual-band antenna module 1 shifts to. On the contrary, the shorter the length L of the first ground extending section 14 is or the larger the distance D is, the higher frequency band the operating frequency band of the dual-band antenna module 1 shifts to. As such, the length L of the first ground extending section 14 and the distance D have to be adjusted so that the dual-band antenna module 1 can transmit the electromagnetic wave signals in a predetermined operating frequency band as required.

In the instant embodiment, the distance D between the first ground extending section 14 and the first antenna 12 ranges from 0.5 mm to 2 mm Additionally, the length L of the first ground extending section 14 ranges between 4 mm to 6 mm.

In addition, the first antenna 12 can couple the second antenna 13 so as to reduce the return loss at the predetermined operating frequency band of the dual-band antenna module 1 and improve the transmission efficiency of the dual-band antenna module 1.

The second ground extending section 15 is located between the first ground extending section 14 and the second antenna 13, and a distance between the first and second ground extending sections 14, 15 is shorter than a distance between the second ground extending section 15 and the second antenna 13. In addition, the length h of the second ground extending section 15 is less than the length L of the first ground extending section 14. The second ground extending section 15 also can be configured to couple the first antenna 12. However, the influence of the second ground extending section 15 on the operating frequency band of the dual-band antenna module 1 is slighter than that of the first ground extending section 14. Specifically, the second ground extending section 15 serves to fine tune a center frequency and a bandwidth of the operating frequency band at which the dual-band antenna module 1 can operate.

To sum up, in the embodiment of the instant disclosure, the first antenna 12 of the dual-band antenna module 1 is not electrically grounded, whereas the second antenna 13 is electrically grounded. By coupling the first antenna 12 to the ground coupling portion 11, coupling the first antenna 12 to the first ground extending portion 14, coupling the first antenna 12 to the second antenna 13 and generating the resonance between the second radiation unit R2 and the high-frequency impedance portion M2 of the second antenna 13, the dual-band antenna module 1 can operate at the operating frequency bands of 2.4 GHz and 5 GHz.

The test results of the dual-band antenna module 1 provided in the embodiment of the instant disclosure show that when the dual-band antenna module 1 is operating at 2.4 GHz, the radiation efficiency is larger than 70%, about 71-81%, and the throughput data at a transmission (Tx) mode is about 80 Mb, and the throughput data at a receipt (Rx) mode is about 99 Mb.

The test results of the dual-band antenna module 1 shows when the dual-band antenna module 1 is operating at 5 GHz, the radiation efficiency is larger than 60%, about 60-81%, and the throughput data at a transmission (Tx) mode is about 155 Mb, and the throughput data at a receipt (Rx) mode is about 166 Mb.

In summary, the first and second antennas of the dual-band antenna module provided in the instant disclosure include less three-dimensional structure; instead, the first and second antennas include mainly two-dimensional structure, thereby reducing the space that the dual-band antenna module occupied and saving the cost. Furthermore, when the dual-band antenna module is operating at the 2.4 GHz band and the 5 GHz band, the radiation efficiency and the throughput data respectively at transmission/receipt (Tx/Rx) modes can satisfy practical demands.

The descriptions illustrated supra set forth simply the preferred embodiments of the instant disclosure; however, the characteristics of the instant disclosure are by no means restricted thereto. All changes, alterations, or modifications conveniently considered by those skilled in the art are deemed to be encompassed within the scope of the instant disclosure delineated by the following claims.

What is claimed is:

1. A dual-band antenna module comprising:

a circuit board having a reference ground plane arranged therein;

a ground coupling portion disposed on the circuit board and electrically connected to the reference ground plane;

a first antenna disposed on the circuit board and spaced from the ground coupling portion, wherein the first antenna and the ground coupling portion are configured to couple with each other, the first antenna includes a first radiation unit, a first feeding portion disposed on the first radiation unit, a U-shaped conductive frame disposed on the first radiation unit, and the U-shaped conductive frame opening toward the circuit board; and a second antenna spaced from the first antenna, wherein the second antenna includes a second radiation unit, a high-frequency impedance portion, and a second feeding portion disposed on the second radiation unit, the second radiation unit and the high-frequency impedance portion are respectively disposed on two opposite surfaces of the circuit board to resonate to each other, and the second radiation unit includes a ground extension portion electrically connected to the reference ground plane.

2. The dual-band antenna module according to claim 1, wherein the first radiation unit includes a high-frequency radiation portion and a first low-frequency radiation portion, the first feeding portion is located at a juncture of the high-frequency radiation portion and the first low-frequency radiation portion, and an operating frequency of the high-frequency radiation portion is higher than that of the first low-frequency radiation portion.

3. The dual-band antenna module according to claim 2, wherein the first low-frequency radiation portion includes:

a L-shaped portion, wherein one end of a long section of the L-shaped portion connects to the first feeding portion;

a U-shaped curved portion connected to the L-shaped portion, wherein the U-shaped curved portion includes:

a bridging portion connecting a short section of the L-shaped portion;

a straight-line portion connecting the bridging portion and parallel to the high-frequency radiation portion, wherein the straight-line portion and the high-frequency radiation portion are both arranged to couple the ground coupling portion; and an extending portion connecting to the straight-line portion and substantially parallel to the bridging portion.

4. The dual-band antenna module according to claim 3, wherein the first antenna includes at least two solder mask patterns disposed on the U-shaped curved portion, and the two solder mask patterns respectively define two preset regions separated from each other and for disposing the U-shaped conductive frame.

5. The dual-band antenna module according to claim 4, wherein two sidewalls of the U-shaped conductive frame respectively connect to the two preset regions so that the U-shaped conductive frame is disposed across over the bridging portion and the extending portion and covers a portion of the U-shaped curved portion.

6. The dual-band antenna module according to claim 2, wherein the high-frequency radiation portion includes a connecting section close to the first feeding portion and an end section farther away from the first feeding portion, and a width of the end section is larger than that of the connecting section.

7. The dual-band antenna module according to claim 1, wherein the second radiation unit includes a second low-frequency radiation portion connecting the ground extension portion, and the second feeding portion is located at a juncture of the ground extension portion and the second low-frequency radiation portion.

8. The dual-band antenna module according to claim 7, wherein the second radiation unit further includes a first branch portion and the first branch portion extends in a direction from a side of the second low-frequency radiation portion closest to the first antenna toward the first antenna.

9. The dual-band antenna module according to claim 7, wherein the high-frequency impedance portion partially overlaps with a vertical projection of the second radiation unit.

10. The dual-band antenna module according to claim 1, further comprising: a first ground extending section located between the first antenna and the second antenna and electrically connected to the reference ground plane, wherein a distance between the first ground extending section and the first antenna is less than a distance between the first ground extending section and the second antenna, and the first antenna is configured to couple the first ground extending section and the second antenna.

11. The dual-band antenna module according to claim 10, further comprising: a second ground extending section electrically connected to the reference ground plane and located between the first ground extending section and the second antenna, wherein a distance between the first ground extending section and the second ground extending section is less than a distance between the second ground extending section and the second antenna, and the first antenna is configured to couple the second ground extending section.

* * * * *